US005972128A

United States Patent [19]

Miwa

[11] Patent Number: 5,972,128

[45] Date of Patent: Oct. 26, 1999

[54] CAST IRON AND PISTON RING

[75] Inventor: Tetsuya Miwa, Niigata, Japan

[73] Assignee: Kabushiki Kaisha Riken, Tokyo, Japan

[21] Appl. No.: 08/945,336

[22] PCT Filed: Feb. 27, 1997

[86] PCT No.: PCT/JP97/00565

§ 371 Date: Oct. 27, 1997

§ 102(e) Date: Oct. 27, 1997

[87] PCT Pub. No.: WO97/32049

PCT Pub. Date: Sep. 4, 1997

[30] Foreign Application Priority Data

Feb. 28, 1996 [JP] Japan ..... 8-067112

[51] Int. Cl.[6] ..... C22C 37/08

[52] U.S. Cl. ..... 148/321; 420/17

[58] Field of Search ..... 148/321; 420/17

[56] References Cited

FOREIGN PATENT DOCUMENTS

| | | | |
|---|---|---|---|
| 24 28 822 | 6/1974 | Germany . | |
| 53-29221 | 3/1978 | Japan | 420/17 |
| 60-247037 | 12/1985 | Japan | 148/321 |
| 61-19759 | 1/1986 | Japan . | |

OTHER PUBLICATIONS

Giesserei–Praxis [Foundry Practice]; 1976, 23/24, pp. 351–384.

Konstruktion [Construction] 44 (1992) pp. 193–204.

Giesserei–Praxis [Foundry Practice]; 1982, 1/2, pp. 1–28.

K. Röhrig and D. Wolters: "Legiertes Gusseisen" [Alloyed Cast Iron], vol. 1, Giesserei–Verlag Gmbh [Foundry Publications], Dusseldorf, 1976, pp. 26 and 41–43.

*Primary Examiner*—Deborah Yee

*Attorney, Agent, or Firm*—Armstrong, Westerman, Hattori, McLeland & Naughton

[57] ABSTRACT

There is provided a piston ring, which has improved wear resistance and seizure resistance, and which does not abrade the cylinder liner made of flaky-graphite cast iron having a hardness of from HRB 85–95.

The composition:

C: 3.0–3.5%;
Si: 2.2–3.2%;
Mn: 0.4–1.0%;
P: not more than 0.2%;
S: not more than 0.12%;
Cr: 0.1–0.3%;
V: 0.05–0.2%;
Ni: 0.8–1.2%;
Mo: 0.5–1.2%;
Cu: 0.5–1.2%; and
B: 0.05–0.1% are contained in the cast iron.

The structure:

from 2 to 20% by area of the undissolved carbides and fine graphite are dispersed in a matrix consisting of either tempered martensite or bainite or both.

The hardness:

HRC 32–45.

4 Claims, 5 Drawing Sheets

Inventive Cast-Iron Material

Inventive Cast-Iron Material

Inventive Cast-Iron Material

Difference due to B Difference due to Cu

Results of Transversal Test

General View of Scuff Tester 1

General View of Scuff Tester 2

Results of Scuffing Test

General View of Wear-Resistance Tester

Test Results of Wet Wear at High Temperature

CAST IRON AND PISTON RING

TECHNICAL FIELD

The present invention relates to cast iron and a piston ring, with improved seizure resistance and wear resistance.

BACKGROUND TECHNIQUE

Wear resistance of high level is required for the piston ring used in a reciprocating internal combustion engine. Therefore, flaky graphite cast-iron material (FC250 or FC300), nodular graphite cast-iron material (FCD700 or the like), and compacted varmicular (CV) graphite cast-iron material proposed in Japanese Unexamined Patent Publication No. Hei 5-86473 or the like have been extensively used heretofore for the piston rings of an internal combustion engine. Also, a cast iron or steel piston-ring, provided with a hard chromium plating layer or a composite dispersion plating layer on the outer peripheral sliding surface for imparting wear resistance, is widely used.

Nevertheless, since the piston ring is caused to slide on the cylinder inner surface at high speed, the piston ring should not only have excellent wear resistance in itself but should also have such property that it does not abrade the cylinder inner-surface, which is the opposed material. Particularly, when the opposed material of the piston ring, i.e., the cylinder liner, is a flaky graphite cast iron, the ferrite precipitation amount of which is increased by lowering the cooling rate at the casting and hence the hardness of which is from HRB approximately 85–95, since the wear resistance of the liner itself is low, a property of the piston ring, that does not abrade the opposed material, is an important factor of the piston ring.

The cast-iron or steel piston ring, which is provided with a hard chromium plating layer or a composite dispersion plating layer on the outer peripheral sliding surface, has an excellent wear resistance in itself but also has a strong abrasive tendency on the flaky graphite cast-iron liner as the opposed material. The above cast-iron or steel piston ring has, therefore, been occasionally used for the 1st ring which is required to have breaking resistance. It was, however, seldom used as the 2nd ring. For the 2nd ring, a piston ring made of flaky graphite cast-iron material or CV graphite cast-iron material has, therefore, been used heretofore, without being provided with a surface-treatment layer. A piston ring consisting of these materials has, however, low wear resistance in itself and low seizure resistance with respect to the opposed material (flaky graphite cast iron). Improvement of these properties is, therefore, desired.

DISCLOSURE OF INVENTION

Considering the above described points, it is an object of the present invention to provide a cast iron with improved seizure resistance and wear resistance, and also to provide a piston ring, which has improved wear resistance in itself, and improved seizure resistance with respect to the flaky graphite cast iron having low hardness of from HRB85–95, and abrades only slightly the opposed material of a liner.

The present invention, which attains the above mentioned object, relates to a cast iron, which has a composition containing C: 3.0–3.5%; Si: 2.2–3.2%; Mn: 0.4–1.0%; P: not more than 0.2%; S: not more than 0.12%; Cr: 0.1–0.3%; V: 0.05–0.2%; Ni: 0.8–1.2%; Mo: 0.5–1.2%; Cu: 0.5–1.2%; and B: 0.05–0.1%, by weight, the balance being essentially Fe and unavoidable impurities, in which cast iron from 2 to 10% by area of the undissolved carbides and fine graphite are dispersed in a matrix consisting of either tempered martensite or bainite or both, and which cast iron has a hardness of from ERC 32–45. The present invention is also related to a piston ring constitued of this cast iron.

The present invention is based on the conventionally used, fine graphite cast-iron material, the chemical composition of which is C, Si, Cr, Ni, Mo and V. B is added to this fine graphite cast iron for the purpose of enhancing the wear resistance in the present invention. A characteristic of the present invention resides in the point that Cu, which has been generally alleged to be not very effective as regards its sliding property is added in the present invention to attain furthermore enhanced seizure resistance and wear resistance than attained by addition of only B.

The composition of the inventive material is described in detail hereinbelow.

C is set from 3.0 to 3.5%. This is because at less than 3.0% of C the chilling is likely to occur. In addition, when C is more than 3.5%, the amount of crystallization of graphite becomes so great that the toughness is impaired, and the amount of crystallization of complex carbide is so diminished that the seizure resistance and wear resistance are low.

Si is set from 2.2 to 3.2%. This is because at less than 2.2%, the chilling is likely to occur. When Si is more than 3.2%, a considerable amount of free ferrite is formed in the matrix structure such that the wear resistance is impaired.

Mn is an unavoidable element which is present in the ordinary steel materials and which stabilizes $Fe_3C$ and hence improves the wear resistance. Mn is set from 0.4 to 1.0%. This is because, at less than 0.4% of Mn, there is little stabilization effect of $Fe_3C$. On the other hand, when Mn is more than 1.0%, the graphitization of C is impeded, to result in the mottled cast iron, thereby impairing the toughness.

P improves the machinability but lowers the impact resistance and promotes the temper embrittlement. P is set, therefore, in the present invention at 0.2% or less.

S impairs the hot-workability and makes the hot-cracking liable to occur. S is, therefore, set at 0.12% or less.

Cr has a function of stabilizing $Fe_3C$ and leaving it as the undissolved carbide. Cr also has a function of homogenizing the structure of castings, even if they are thick. Cr furthermore enhances the stain resistance. However, Cr promotes chilling and brings about excessive increase in hardness of the castings. The Cr is set, therefore, from 0.1 to 0.3%.

V has a function of stabilizing $Fe_3C$ and hence leaving it as the undissolved carbide, similarly to Cr. In addition, V is effective for refining the graphite and iron crystals and uniformly dispersing the graphite. However, when a large amount of V is added, the amount of crystallization of composite carbide becomes so great that the toughness is impaired. The V content is, therefore, set from 0.05 to 0.2%.

Ni is effective for refining the graphite and uniformly dispersing the graphite and also for densifying the matrix structure. Ni, however, also functions to impair the stability of $Fe_3C$. The Ni content is, therefore, set from 0.8 to 1.2%.

Mo enhances the resistance against heat setting at high temperature and the wear resistance. Mo also has an effect of enhancing the corrosion resistance concomitant with Cr. In order for Mo to demonstrate its effect, the content of 0.5% or more is necessary. However, at more than 1.2% of Mo, there is no further appreciable enhancement effect, and, moreover, the material cost is increased. The Mo content is, therefore, set from 0.5 to 1.2%.

Cu has a function of graphitizing and refining the graphite, and is effective for enhancing the workability, as is well known. The present inventor discovered that Cu is effective for uniformly dispersing the boron compound and hence enhancing the wear resistance of the material. Boron in the conventional boron-added cast iron forms boron carbide and is effective for enhancing the wear resistance of cast iron material. However, since boron carbide is likely to segregate, such portions, where there is little precipitation of boron carbide, and where the wear resistance is not high, were detected in the cast-iron material. When Cu is further added to the boron-added cast iron, the precipitation of boron carbide is homogenized throughout the entire material, so that the wear resistance of the entire material is enhanced. The Cu content is set from 0.5 to 1.2%. This is because, in order for Cu to demonstrate this effect, 0.5% or more of the copper addition is necessary. This effect does not change at an addition of 1.2% or more.

B precipitates as the boron compound and enhances the wear resistance. The boron content is set from 0.05 to 0.1%, because at 0.05% or less of B, its effect is not realized, and, further at more than 0.1% the chilling is so promoted that the toughness is impaired.

The structure of cast-iron material according to the present invention is that fine graphite and boron compound are uniformly dispersed in the matrix structure, i.e., the tempered martensite and or bainite. In addition, a part of carbide formed by Cr, V, Fe and the like is left in the undissolved state.

In order to attain the above-described structure, the castings are, preferably, held at a temperature of from 870 to 930° C. for 8–12 minutes per 10 mm of the thickness of castings. Subsequently, quenching is carried out at a cooling rate of from 100–200° C./min so as to carry out the solution treatment, followed by tempering at 520–570° C. The quenching may, however, be replaced with the cooling stage after the casting. The heat treating conditions are adjusted so that the hardness of from HRC 32–45 is obtained. When the hardness is less than HRC 32, the wear resistance of cast iron in itself is unsatisfactory. On the hand, when the hardness exceeds HRC 45, the wear amount of the opposed material increases. The hardness should, therefore, be adjusted in the above range. Ferrite, which may be present in some amount in the cast iron having the hardness within that range, virtually does not impair the wear resistance.

BEST MODE FOR CARRYING OUT THE INVENTION

The present invention is hereinafter described in detail with reference to the examples.

Mild steel, Ti—V pig iron, Fe pig iron or foundry pig-iron, C powder, Fe—Mn, Fe—Si, Fe—Cr, Fe—Ni, Fe—Mo, Me—Cu, and Fe—V were used as the raw materials and were melted in a high-frequency electric furnace. Tapping was carried out at 1570° C. while inoculating by the addition of 0.5% of Fe-Si and 0.1% of Inoculine. Casting was carried out into a green-sand mold for a test specimen 50 mm×90 mm×7 mm in size. The sample was tempered at 580° C. to form the specimen structure which is tempered martensite and bainite. Note that five elements including Cu and B are added.

In addition, comparative materials were prepared: Conventional fine graphite cast-iron material comprising C, Si, Mn, Cr, Ni, Mo and V (hereinafter referred to as "Conventional Material"); cast-iron material with the addition of only B to the Conventional Material (hereinafter referred to as "B-added Material": and compacted varmicular graphite cast-iron material (hereinafter referred to as "CV cast iron").

The chemical analyses of the tested materials and the comparative materials are as shown in Table 1.

| | | C | Si | Mn | P | S | Cr | Ni | Mo | Cu | V | B |
|---|---|---|---|---|---|---|---|---|---|---|---|---|
| Inventive Materials | ① | 3.22 | 2.66 | 0.72 | 0.10 | 0.04 | 0.12 | 0.88 | 0.90 | 0.83 | 0.08 | 0.054 |
| | ② | 3.28 | 2.86 | 0.78 | 0.11 | 0.05 | 0.17 | 0.94 | 0.98 | 0.87 | 0.08 | 0.092 |
| | ③ | 3.15 | 2.76 | 0.70 | 0.12 | 0.06 | 0.16 | 0.84 | 0.92 | 0.88 | 0.09 | 0.073 |
| | ④ | 3.19 | 2.78 | 0.75 | 0.12 | 0.06 | 0.15 | 0.92 | 0.93 | 0.65 | 0.08 | 0.076 |
| | ⑤ | 3.16 | 2.76 | 0.74 | 0.11 | 0.04 | 0.14 | 0.91 | 0.95 | 1.18 | 0.09 | 0.077 |
| Comparative Materials | Conventional Material | 3.46 | 3.04 | 0.69 | 0.08 | 0.06 | 0.12 | 0.80 | 0.98 | — | 0.09 | — |
| | B-added Material | 3.30 | 2.94 | 0.69 | 0.09 | 0.06 | 0.13 | 0.08 | 1.01 | — | 0.08 | 0.072 |
| | CV cast Iron Material | 3.54 | 2.36 | 0.49 | 0.05 | 0.01 | 0.12 | 0.99 | — | 2.14 | 0.05 | — |

Figure 1:
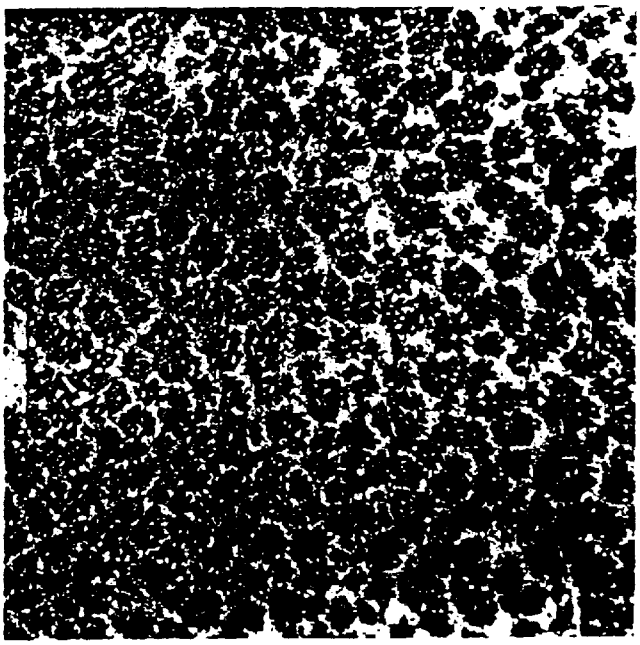
FIG. 1 is a microscope photograph showing the structure of the inventive cast-iron material without etching (magnification of 100).
Figure 2:
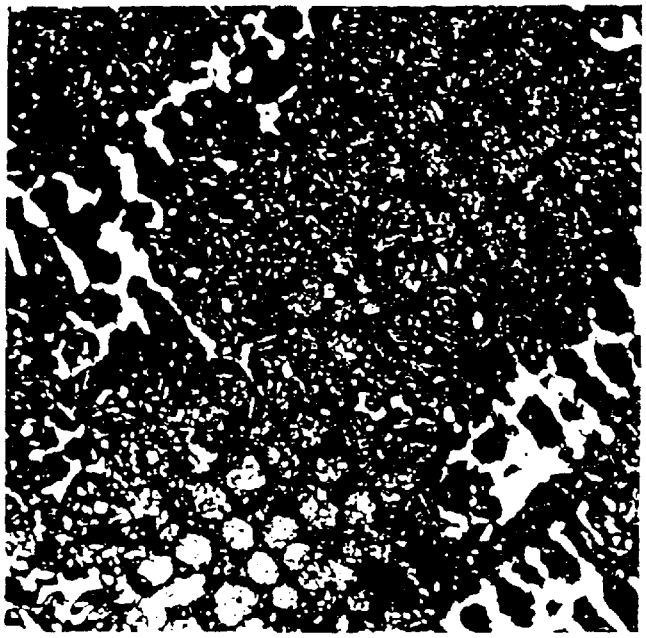
FIG. 2 is a microscope photograph showing the structure of the inventive cast-iron material etched by Nital (magnification of 400).

FIG. 1 is a microscope photograph of the inventive cast-iron material (magnification of 100 times) obtained as described above, observed without etching so that the graphite is apparent. FIG. 2 is an Nital etched microscope photograph at magnification of 400 times.

Phases, which appear white and accicular, are the graphite. The length of the graphite is approximately a few tens $\mu$m at the maximum. From FIG. 2, the morphology of the respective phases other than the graphite becomes apparent. The white phase is undissolved carbide, and the black phase is tempered martensite. In the tempered martensite, the fine graphite is dispersed. The gray phase in an island form is bainite.

Mechanical Properties

Figure 3:
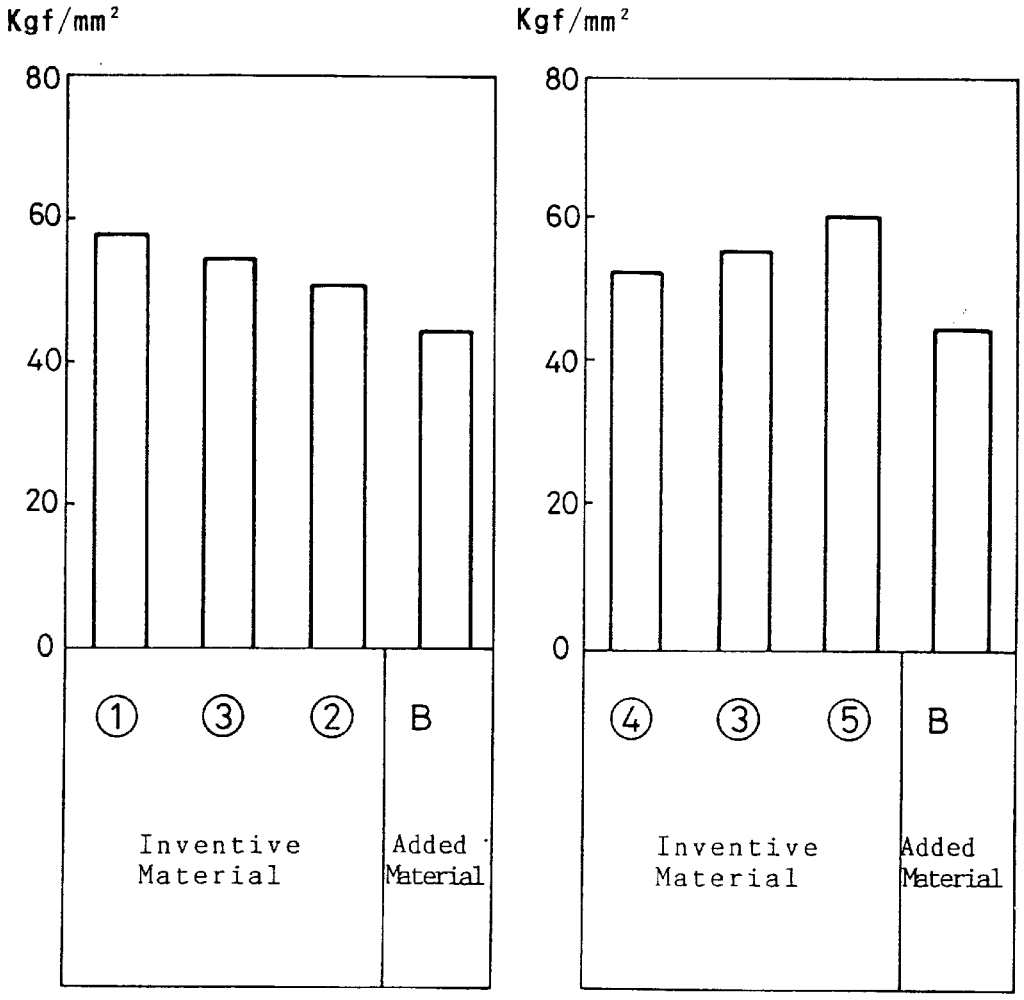
FIG. 3 is a graph showing the results of the transversaltest.

Transversal test specimens 5×5×10 mm in size were taken from the test materials and were subjected to the three-point transverse test. The results of the test are as shown in FIG. 3. As is clear from FIG. 3, the transverse strength of the inventive materials is high, when the amount of Cu is large (⑤) and that of B is little (①).

Scuffing Test

Test specimens 5×5×90 mm in size were taken from the test materials, i.e., the inventive cast-iron materials, Conventional Material and CV Cast Iron. They were polish finished. The opposed material used was the low-hardness gray cast-iron liner having a hardness of from HRB 88.

Figure 4:
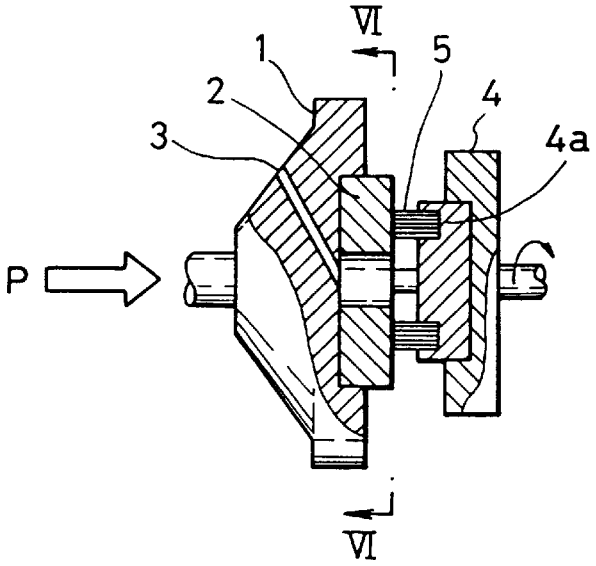
FIG. 4 is a partial cross sectional drawing showing the general view of the test apparatus used for the scuffing test.
Figure 5:
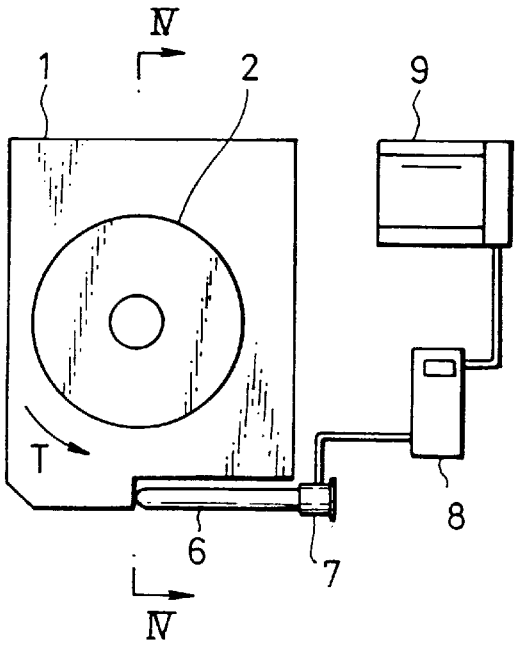
FIG. 5 shows the general view of a test apparatus used for the scuffing test and is a side elevational view of FIG. 4.

The general view of the test apparatus is schematically shown in FIGS. 4 and 5. A polish-finished disc 2 of 80 mm in diameter and thickness of 10 mm is detachably mounted on the stator holder 1. Lubricating oil is supplied onto the center of the disc 2 from its rear side. A hydraulic apparatus (not shown) exerts a predetermined pushing pressure P to the stator holder 1 in the right hand direction. A rotor 4 is arranged opposite to the disc 2 and is rotated by means of the driving apparatus (not shown) at a predetermined speed. The holder of test specimens 4*a* is attached on the end surface of the rotor 4, facing the disc 2. Four test specimens 5, the sliding surface of which is square shape, are arranged concentrically and are spaced at an equal distance. The test specimens 5 are mounted detachably on the holder of test specimens 4 and are slidable on the disc 2.

In the apparatus as described above, a predetermined pushing pressure P is applied to the stator holder 1, so that the disc (opposed material) 2 and the test specimen 5 are brought into contact at a predetermined surface pressure. While in such contact, oil is fed onto the sliding surface through the oil-pouring port 3 at a predetermined oil-feeding rate. The rotor 4 is rotated while feeding the oil. The pressure exerted on the stator 1 is increased stepwise at a constant time interval. The rotation of the rotor 4 causes the rotation between the specimen 5 and the opposed disc 2. The torque T generated on the stator 1 by the rotation of stator 1 (the torque generated by the friction force) is caused to exert its effect via the spindle 6 to the load cell 7. Change in the torque effect is detected by the dynamic strain gauge 8 and recorded in the recorder 9. When the torque T abruptly changes, it is judged that the seizure has occurred. The contact surface pressure when this occurs is deemed to be the seizure-occurring pressure. The magnitude of this value provides judgment of improved or failed scuff resistance.

Figure 6:
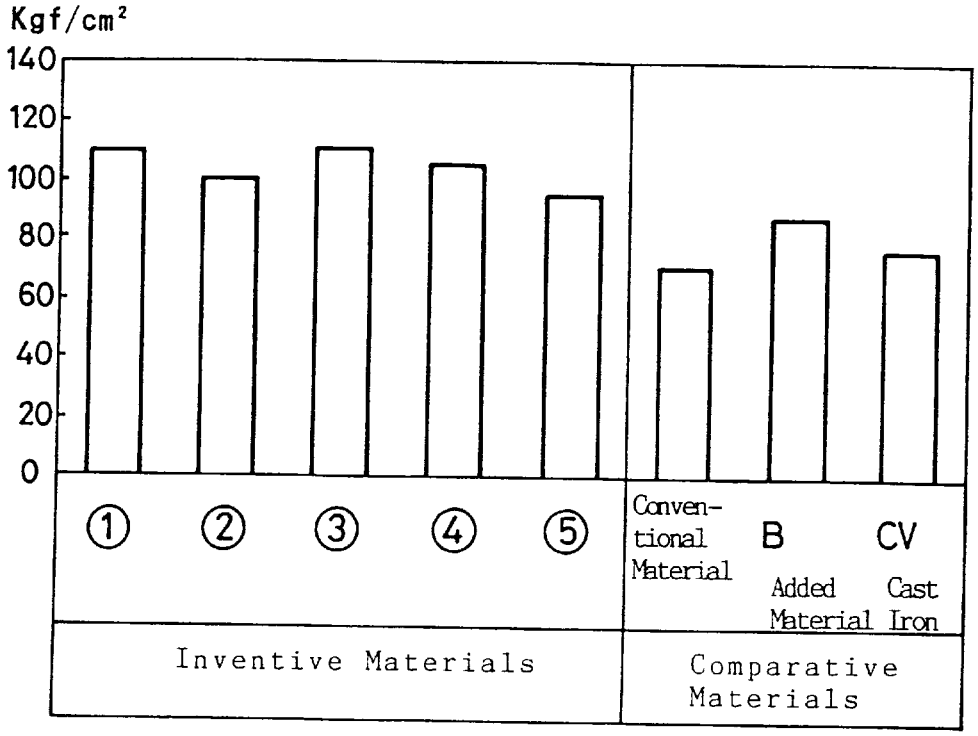
FIG. 6 is a graph showing test results of scuffing test.

The test conditions are shown in the following: the sliding speed—8 m/sec; lubrication oil and oil-feeding condition—motor oil #30, temperature of 80° C., and 400 ml; the contact pressure—20 kg/cm$^2$; holding—3 minutes at this pressure, thereafter increase by 10 kg/cm$^2$ after lapses of 3 minutes each. The test results are shown in FIG. 6. It is apparent that the seizure resistance of the inventive cast-iron materials is superior to that of Conventional Material and even compared with the B-added Material. Cu addition, furthermore, improves the wear resistance.

Wear Test

Figure 7:
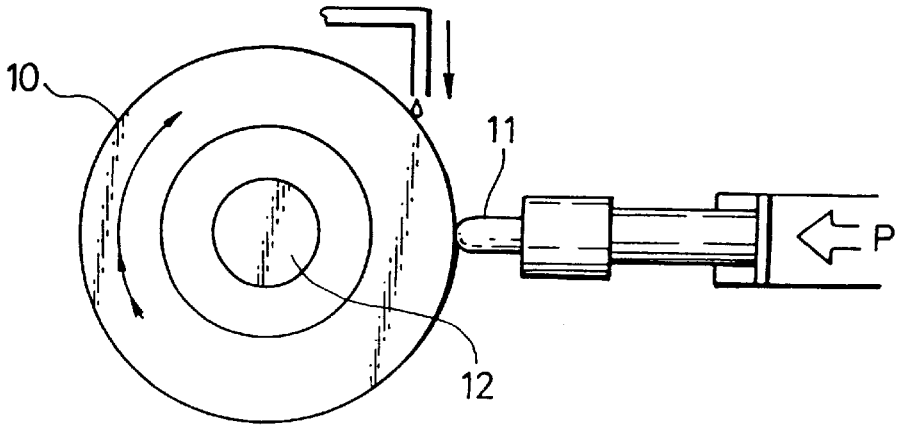
FIG. 7 shows the general view of a test apparatus used for the wear test and is a side elevational view of FIG. 4 as seen indicated by the arrows V—V.

The test specimens used were 5×5×21 mm in size, one end of which was shaped to 10 mm R. The general view of the test apparatus is schematically shown in FIG. 7. A heater 12 was accommodated in the axial portion of the cylindrical drum 10 to maintain a predetermined temperature. The cylindrical drum 10 is rotated at a predetermined speed by a driving apparatus (not shown). The R shaped portion of the test specimen 11 was pressed against the lateral surface of the drum 10 by means of an air cylinder.

In the apparatus as described above, a test specimen was caused to abut on the lateral surface of the drum 10 which was set at a predetermined temperature. The specimen was held only for a predetermined time. Then, the wear amount and hence wear resistance of the specimen was judged by the decrease in the height dimension, and the wear amount and hence wear resistance of the opposed material was judged by the crosssectional area of a groove formed on the lateral side of the drum 10.

The test conditions are as shown below: the temperature—180° C.; the lubrication oil and oil-feeding condition to lubricate the sliding surface—motor oil #30, and oil-feeding rate—0.15 cc/sec; the friction speed—0.25 m/sec; the contact load—6 kgf; and the test time—4 hours.

Figure 8:
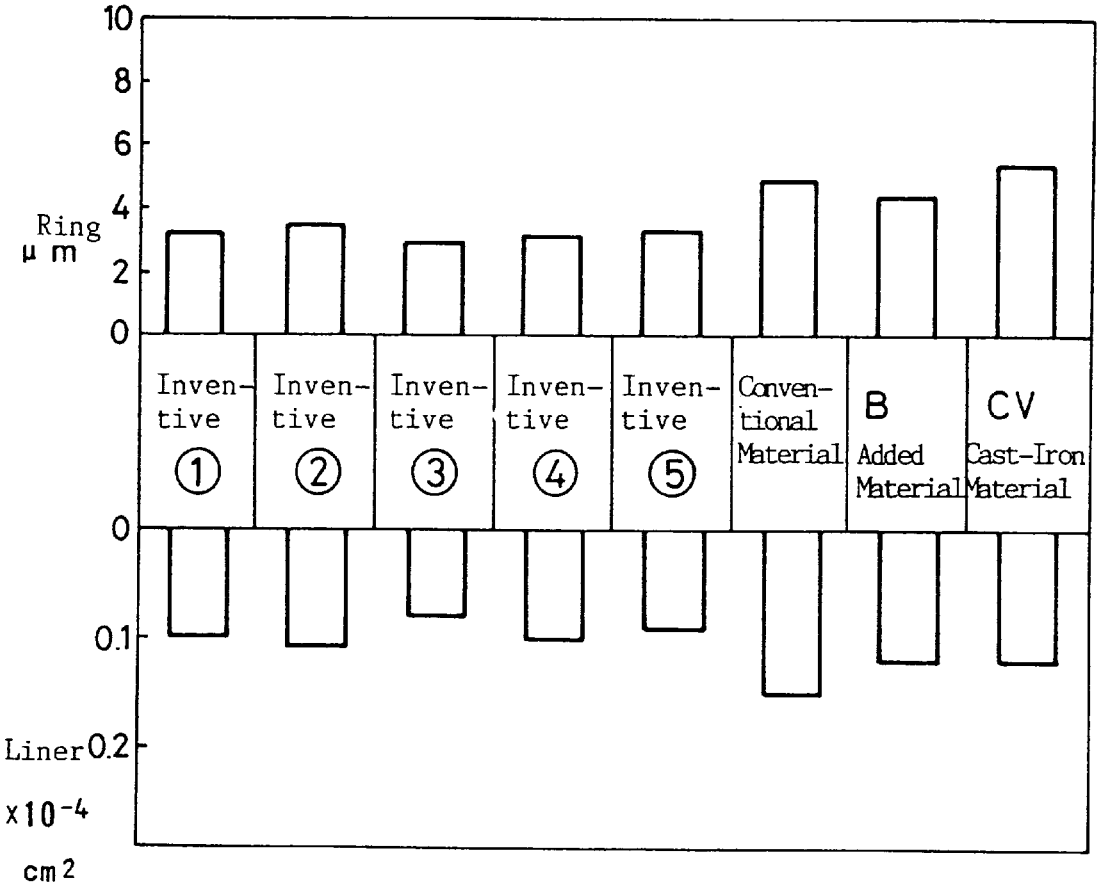
FIG. 8 is a graph showing the results of the wear test.

The test results are shown in FIG. 8.

It is apparent from FIG. 8 that the self wear amount and the opposite-material wear amount are small in the case of the inventive cast-iron material as compared with Conventional Material and the B-added Material. Thus, the wear resistance of the inventive cast material is excellent.

Industrial Applicability

In the inventive cast-iron material according to the present invention not only B but also Cu are added to improve the scuff resistance and wear resistance. Particularly, the inventive cast-iron material is extremely advantageous as the 2nd piston ring material, the opposed material of which is the gray cast-iron liner having a low hardness of from HRB 85 to 95.

I claim:

1. A cast iron, which has a composition containing C: 3.0–3.5%; Si: 2.2–3.2%; Mn: 0.4–1.0%; P: not more than 0.2%; S: not more than 0.12%; Cr: 0.1–0.3%; V: 0.05–0.2%; Ni: 0.8–1.2%; Mo: 0.5–1.2%; Cu: 0.5–1.2%; and B: 0.05–0.1%, by weight ratio, the balance being essentially Fe and unavoidable impurities, in which cast iron from 2 to 20% by area of the undissolved carbides and fine graphite are dispersed in a matrix consisting of either tempered martensite or bainite or both, and which cast iron has a hardness of from HRC 32–45.

2. A piston ring, for which the cast iron according to claim 1 is used.

3. A piston ring according to claim 2, used as the 2nd ring.

4. A piston ring according to claim 3, in which the opposed material is a cylinder liner made of a low-hardness flaky graphite cast-iron having a hardness of from HRB 85–95.

* * * * *